United States Patent [19]

Schmidt et al.

[11] Patent Number: 4,644,881

[45] Date of Patent: Feb. 24, 1987

[54] EMBROIDERY FRAME SECURING DEVICE

[75] Inventors: Gottfried Schmidt, Stebach; Edgar Busch, Trippstadt; Lothar Schilling, Kaiserslautern, all of Fed. Rep. of Germany

[73] Assignee: Pfaff Industriemaschinen GmbH, Fed. Rep. of Germany

[21] Appl. No.: 870,160

[22] Filed: Jun. 2, 1986

[30] Foreign Application Priority Data

Jun. 3, 1985 [DE] Fed. Rep. of Germany ... 8516137[U]

[51] Int. Cl.[4] ..... D05C 7/04

[52] U.S. Cl. ..... 112/103

[58] Field of Search ..... 112/103, 102, 92, 119

[56] References Cited

U.S. PATENT DOCUMENTS

| | | | |
|---|---|---|---|
| 3,482,536 | 12/1969 | Hoever | 112/103 |
| 3,664,288 | 5/1972 | Von Boden et al. | 112/103 |
| 4,444,133 | 4/1984 | Bolldorf et al. | 112/103 |

FOREIGN PATENT DOCUMENTS

| | | |
|---|---|---|
| 7823992 | 8/1978 | Fed. Rep. of Germany . |
| 29557 | 11/1903 | Switzerland . |

*Primary Examiner*—Ronald Feldbaum

*Attorney, Agent, or Firm*—McGlew and Tuttle

[57] ABSTRACT

An apparatus for securing and releasing an embroidery frame to a clamping rail comprises a connecting piece guide with a bore therethrough and a rod extending through the bore and extending along the clamping rail and guided in the bore for movement in the connecting piece guide bore. The rod carries a pressure piece which is movable with the rod. The clamping rail has a plurality of spaced apart embroidery frame pin receiving openings and embroidery frames are secured by inserting the pins of the frame into the openings. Each pin has a side with a cutout and each pin receiving opening has a fixed spacer plate adjacent the opening which carries a resilient holder which may be engaged in a cutout of the embroidery frame pin when it is inserted into the associated opening. Engagement and disengagement of the resilient holder with the pin is effected by a lever which may engaged by a person's hand which is mounted on the clamping rails so that it may be pulled outwardly or pushed inwardly to cause movement of the rod to effect the shifting of a pressure piece carried by the rod to either deflect the holder toward or away from the cutout of the pin for effecting either the release or securement of the pin as desired. The handle may be connected to shift a connecting piece carrying a rod which actuates one or more resilient holders to release or hold one or more embroidery frame pins as desired.

5 Claims, 3 Drawing Figures

EMBROIDERY FRAME SECURING DEVICE

FIELD AND BACKGROUND OF THE INVENTION

This invention relates in general to embroidery machines and in particular to a new and useful support for embroidery frame holders for receiving pins fastened on tongues of the embroidery frame and which may be fixed by locking means.

In German utility model No. 78 23 992, a device for the attachment of several embroidery frames on multi-head embroidering machines is shown. Each embroidery frame is equipped with two frame holders spaced from each other, each carrying a lock pin. One of the two lock pins is inserted in a fixed hook, the other in a spring loaded catch hook pivotable about a bearing stud. The catch hook is provided with a release arm, the front face of which is formed as a lead-in cam for the lock pins of the embroidery frames. The fixed hooks and catching hooks are connected with bearing blocks arranged at the frame guide. The disadvantage of the described device is that each embroidery frame must be locked individually. In embroidery machines with several embroidery points to be worked simultaneously this resultes in a complicated and time consuming changing of the individual frames.

In Swiss Pat. No. 29,577 a clamping device on cloth frames of embroidering machines for simultaneous actuation of two clamping rods from a single point is disclosed. The axle of a handle is pivotably arranged in a bearing secured on a cross-beam of the cloth frame and serves, in addition, to receive a lever controllable with the handle, which lever is connected at both sides via rods and angle pieces with the clamping rods that receive and clamp a strip of cloth. The individual rods and angle pieces of the arrangement are connected together by joints.

By turning the handle a movement is produced and transmitted via the linkage to the clamping rods, which, by their shifting movement, uniformly tension the clamped cloth strip. After completed clamping, a ratchet holds the device in clamped position. After the cloth has been embroidered, it is released and the embroidered portion is wound up on one of the two beams.

In the above described device, a linkage is provided for the transmission of the movement necessary for the clamping process. This results in a heavy construction which requires much space. Besides, the numerous joints for interconnection of the rods cause play (slip) in the movement transmission.

SUMMARY OF THE INVENTION

The invention provides a support for embroidery frames where despite a compact and light-weight construction a plurality of embroidery frames can be arranged side by side which through a central fixing system can be locked or released simultaneously.

Attached to the support for embroidery frames of the invention is a clamping rail. This clamping rail is provided with a handle for the simultaneous locking or releasing of several frames, which handle is connected with two displaceable rods extending in the longitudinal direction of the clamping rail and guided along the sidewalls of pressure pieces, for the transmission of the shifting movement produced by the handle.

By this arrangement, the transmission, caused by the handle of the movement occurs without play by means of weight, and space saving rods at several clamping points of the clamping rail.

The individual clamping points are also designed in a space -and weight-saving manner. Holders, mounted on bolts, form the clamping points and pairs of holders can be pressed against one another and pressed into grooves in pins which are fastened at the embroidery frames. Thereby the pins are clamped. The holding means needed for fixing can be made light and compact. Additional parts for locking the pins are not needed, so that the locking system fulfills its function at little technical cost.

Another feature of light-weight design in the invention are the pressure pieces, which both guide the rods for the transmission of the movement and also bring about the clamping process of the holding means, in that the displaceable pressure pieces press the specially formed holding means increasingly in a direction against each other as the slide path increases.

Accordingly it is an object of the invention to provide a support for embroidery frames with holders for receiving pins fastened on tongues of the embroidery frames and with pins which can be inserted into the holders and fixed by locking means.

A further object of the invention is to provide an apparatus for securing and releasing an embroidery frame which includes rods which are longitudinally displaceable by means of a handle and which are arranged inside a clamping rail, the rods being provided in the region of clamping pins of an embroidery frame and which includes holding elements arranged adjacent openings of clamping rails into which the pins of the embroidery frames are positioned and wherein a clamping lever is effective to shift a rod carrying pressure pieces which either effect engagement of the holding means or release of the holding means from the pins.

A further object of the invention is to provide a device for securing embroidery frames in respect to clamping rails which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
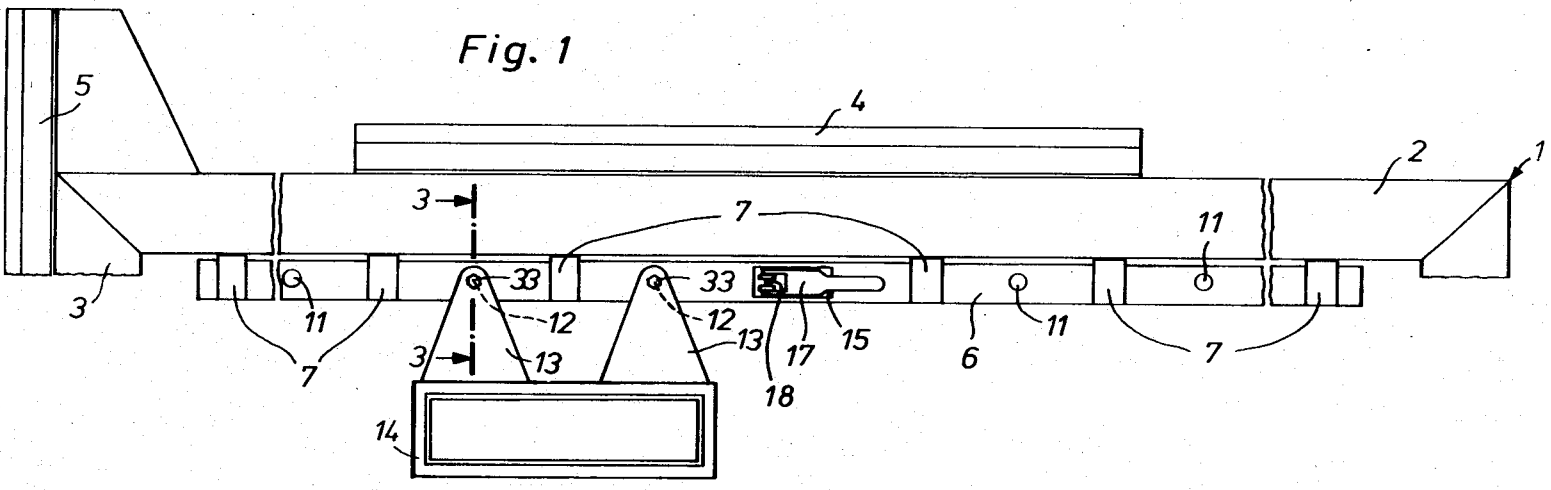
FIG. 1 is an elevational view of an embroidery frame support, provided with two parallel clamping rails and an inserted embroidery frame.

Referring to the drawings in particular the invention embodied therein comprises apparatus for securing and releasing an embroidery frame to a clamping rail 6. In accordance with the invention one or more embroider frames 14 are each provided with tongues 13 which carry pins 12 which are engageable into selective openings or holes 11 of clamping rails 6 and these pins 12 of the embroidery frames are secured into the openings 11 by means of holding devices 29 which in the embodiment shown comprise resilient springs 29.

A support 1 shown in FIG. 1, for embroidery frames of a small embroidering machine, contains a stringer 2 and a cross member 3. The members 2 and 3 are provided with guide rails 4 and 5, which permit quick and smooth coupling of the support 1 to the mounts (not shown) provided for that purpose on the small embroidering machine.

On stringer 2 a clamping rail 6 is fastened with clips 7. The clamping rail 6 is made up of a U-shaped top section 8 and a likewise U-shaped bottom section 9. The bottom section 9 covers the clamping rail 6 on the underside and is fastened to the top section 8 by screws 10 (FIG. 2).

The top section 8 is provided with a plurality of holes 11. The holes 11 are equidistant from each other and serve to receive pins 12 which are applied on tongues 13 of embroidery frames 14. The top section 8 is additionally provided with a rectangular cutout 15 for the passage of coupling elements 16 which form a connection between a lever 17 disposed outside the clamping rail 6 as handle and a locking system inside the clamping rail 6.

Figure 2:
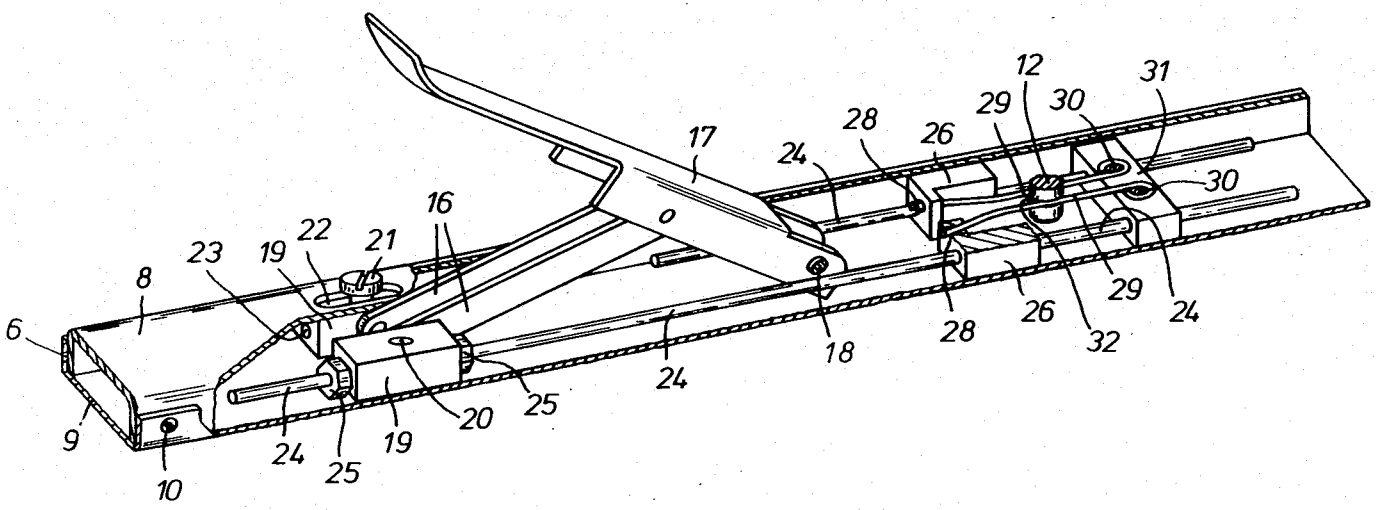
FIG. 2 is an enlarged perspective view partly in section of the support showing the parts required for movement transmission and for the clamping process.

In FIG. 2 is shown a part of the clamping rail 6 and of the locking system arranged therein. Lever 17 is mounted by a journal 18 shown in section in a bore of the top section 8 and is articulated by the coupling elements 16 to two connecting pieces 19.

Screwed into each threaded bore 20 of the connecting pieces 19 is a screw 21, which is guided in a slot 22 of the top section 8 and pressed onto the top section 8 more or less strongly by being screwed in more or less tightly, so that the sliding friction forces and hence the forces which hold the locking system in fixed position are adjustable.

Figure 3:
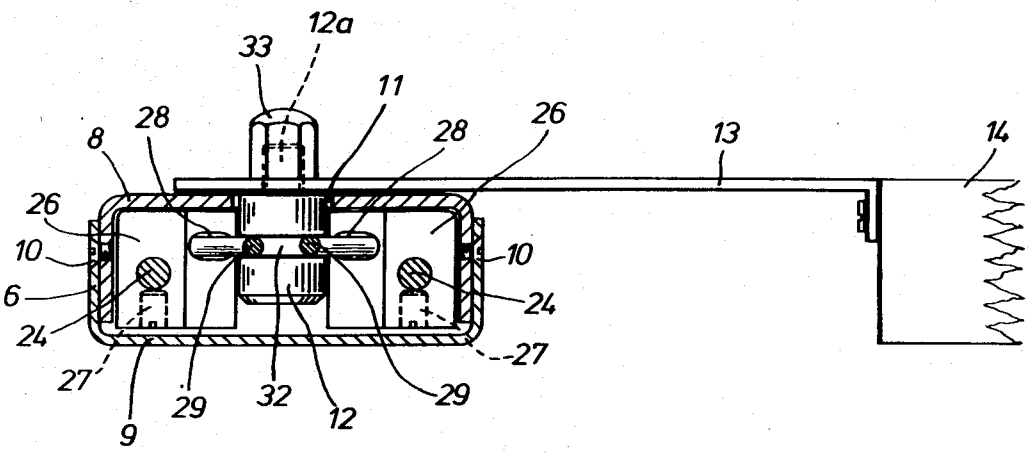
FIG. 3 is a section taken along the line 3—3 of FIG. 1 showing one of the clamping points.

The connecting pieces 19 have threaded bores 23, into which threaded rods 24 are screwed and secured by nus 25. The rods 24 are connected with pressure pieces 26, these being clamped by the studs 27 (FIG. 3) to prevent relative motion between the rods 24 and pressure pieces 26. At each of the pressure pieces 26, which guide the rods 24 in movement direction, a slot for receiving a holder or thigh spring 29 as holding means is provided (FIG. 3). The two thigh springsd 29 of a clamping point are in mirror symmetrical arrangement with one another and are mounted to pivot around bolts 30. The bolts 30 are fastened on a fixed spacer plate 31.

FIG. 3 shows in transverse section a region of the clamping rail 6, wherein two thigh springs 29 engage in a peripheral groove 32 cut out in the pin 12 inserted in bore 11 for locking. At its upper end the pin 12 has a threaded cylindrical part 12*a*, which is passed through a hole in tongue 13 and is secured with a cap nut 33.

The clamping of one of the embroidery frames 14 by the clamping rail 6 is done as follows:

The pins 12 of the embroidery frame 14 are to be fitted into holes 11 in the top section 8. Thereafter the lever 17 is turned from the release to the locking position. The movement of lever 17 around pivot point 18 is transmitted via the coupling elements 16 to the connecting pieces 19, which executes a movement in lengthwise direction of the clamping rail 6. The connecting pieces 19 displace the rods 24 fastened to them and hence the pressure piecs 26 connected with the rods 24 also in lengthwise direction of the clamping rail 6, owing to which the pressure pieces 26 change their position relative to the fixed thigh springs 29.

At the ends opposite their bearing points, the thigh springs 29 are bent toward the outer walls of the top section 8. During displacement of the pressure pieces 26 in the direction of the free spring ends, the two mirror-symmetrically arranged thigh springs 29 of a clamping point are swiveled relative to each other until they engage in the peripheral grooves 32 of the pins 12, thereby clamping them.

For unlocking, the connecting pieces 19, the rods 24 and the pressure pieces 26 are displaced in the direction of the mounted spring ends by pivoting of the lever 17 into release position, until the pressure pieces 26 no longer push the thigh springs 29 into the grooves 32 in the pins 12.

Thereafter the embroidery frame 14 can be taken out of the clamping rail 6.

For the simultaneous locking or unlocking of a plurality of embroidery frames 14, the rods 24 are connected with all pressure pieces 26 arranged in a clamping rail 6, so that all pins 12 of the embroidery frames 14 can be locked or unlocked simultaneously by actuation of the common lever 17.

While a specific embodiment of the invention has been shown and described in detail to illustrate the application of the principles of the invention, it will be understood that the invention may be embodied otherwise without departing from such principles.

What is claimed is:

1. An apparatus for securing and releasing an embroidery frame to a clamping rail, comprising a clamping rail having a plurality of spaced apart embroidery frame pin receiving openings, a hand lever having one end pivotably mounted on said clamping rail, a connecting piece within said clamping rail, a coupling element connected between said connecting piece and said hand lever in a spaced location from its pivotal connection to said clamping rail and having a bore therethrough, a rod extending through the bore of said connecting piece and secured to said connecting piece, said lever being movable to move said connecting piece with said rod to shift said rod along said clamping rail, said embroidery frames having at least one pin engageable in the selective opening of said clamping rail, said pin having side with a cutout, a resilient holder mounted adjacent each opening and including resilient members disposed in the path of movement of said rods, said rods having a pressure piece engageable with said holders and being movable upon flexing of said lever to engage and disengage said resilient holder for the purpose of engaging said resilient holder with a cutout of said pin to secure said pin in the clamping rail and to disengage from said pin to release said pin.

2. A support for embroidery frames which have tongues carrying a pin which have a side cut out and which can be inserted into openings of a clamping rail having holders therein, comprising a clamping rail having spaced pin receiving openings therealong, rod longitudinally displaceable in said clamping rail, holding means on said clamping rail adjacent said rod, a handle on said clamping rail which is pivotally movable thereon, said rod being provided in the region of the clamping points of the embroidery frames and having at lest one pressure piece adapted to press said holding means when moved with said rod into and out of the cutout of said pin.

3. A device according to claim 2, wherein all of the clamping points of the locking system are arranged inside said clamping rail and at least one coupling element connected to said handle in spaced location from its pivotal connection to said clamping rail and disposed outside of the clamping rail.

4. A device according to claim 2, wherein said holding means are mounted at one end on fixed bolts.

5. A device according to claim 2, wherein said holding means comprise a spring element having free ends which are bent toward the edges of said clamping rail and including expansion guides in which said holding means are disposed forming a part of said pressure pieces.

* * * * *